US006349710B1

(12) United States Patent
Kawai et al.

(10) Patent No.: US 6,349,710 B1
(45) Date of Patent: Feb. 26, 2002

(54) ENGINE COMBUSTION CONTROLLER

(75) Inventors: Takashi Kawai, Anjo; Hiroyuki Mizuno, Toyota, both of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/645,368

(22) Filed: Aug. 24, 2000

(30) Foreign Application Priority Data

Sep. 7, 1999 (JP) ..... 11-253082

(51) Int. Cl.[7] ..... F02D 41/14; F02D 41/34

(52) U.S. Cl. ..... 123/685; 123/686; 123/688; 123/443; 123/704; 701/103; 701/110; 701/114

(58) Field of Search ..... 123/685, 686, 123/688, 479, 480, 445, 443, 704, 674, 679, 488; 701/103, 105, 106, 110, 114

(56) References Cited

U.S. PATENT DOCUMENTS

| | | | | | |
|---|---|---|---|---|---|
| 4,175,521 | A | * | 11/1979 | Hattori et al. | 123/686 |
| 4,703,430 | A | * | 10/1987 | Amano et al. | 701/106 |
| 4,787,357 | A | * | 11/1988 | Nishikawa et al. | 123/686 |
| 4,805,578 | A | * | 2/1989 | Kikuchi et al. | 123/680 |
| 4,837,698 | A | * | 6/1989 | Amano et al. | 701/110 |
| 5,615,661 | A | * | 4/1997 | Suzuki | 123/688 |

FOREIGN PATENT DOCUMENTS

| | | | | |
|---|---|---|---|---|
| EP | 0 569 055 A | * | 11/1993 | F02D/41/14 |
| JP | 58-104341 A | * | 6/1983 | 123/674 |
| JP | 62-103439 A | * | 5/1987 | F02D/41/14 |
| JP | 4-8841 A | * | 1/1992 | F02D/41/14 |
| JP | 4-8842 A | * | 1/1992 | F02D/41/14 |
| JP | 5-26085 | | 2/1993 | |
| JP | 5-321726 | * | 12/1993 | F02D/41/14 |

* cited by examiner

*Primary Examiner*—Henry C. Yuen
*Assistant Examiner*—Hieu T. Vo
(74) *Attorney, Agent, or Firm*—Kenyon & Kenyon

(57) ABSTRACT

An engine combustion controller for an engine having a fuel supply system selects an engine combustion mode from one of lean combustion, in which an air fuel mixture leaner than a stoichiometric mixture is burned, and stoichiometric combustion, in which a stoichiometric mixture is burned, in accordance with an operating state of the engine and controls, via feedback, the air fuel ratio of the air fuel mixture when the stoichiometric combustion is performed using air-fuel ratio compensating value that are based on the composition of the engine exhaust gas. A preliminary tester checks the fuel supply system and determines that the fuel supply system is in a normal state when certain preliminary test conditions are satisfied, which includes checking the feedback compensating value. A prohibiter prevents lean combustion when the preliminary tester determines that the state of the fuel supply system is ambiguous. A main tester tests the fuel supply system and determines that the fuel supply system is in an abnormal state when certain main test conditions are satisfied, which includes checking the feedback compensating value.

20 Claims, 14 Drawing Sheets

ENGINE COMBUSTION CONTROLLER

BACKGROUND OF THE INVENTION

The present invention relates to an engine combustion controller that selects an optimal one of combustion modes, which include lean combustion and stoichiometric combustion. More particularly, the present invention pertains to an engine combustion controller that feedback controls the air fuel ratio of an air fuel mixture when stoichiometric combustion is performed based on the composition of the exhaust gas.

In a conventional engine, the air fuel ratio of an air fuel mixture is feedback controlled so that the air fuel ratio becomes stoichiometric. A stoichiometric air fuel ratio enables a catalytic converter to effectively purify exhaust gas. When controlling the air fuel ratio, the fuel concentration of the mixture is adjusted based on an output signal of an air fuel ratio sensor arranged in a passage of the exhaust gas.

When the air fuel ratio is feedback controlled, an abnormality in the fuel supply system may cause an undesirable air fuel ratio. This would hinder appropriate feedback control of the air fuel ratio. In such case, the components of the exhaust gas are not in the desirable state. Thus, the catalytic converter cannot purify the exhaust gas efficiently. This may result in undesirable emissions.

To prevent such undesirable emissions, Japanese Unexamined Patent Publication No. 5-26085 describes a system for detecting abnormalities in a fuel supply system. The system determines the occurrence of an abnormality in the fuel supply system when a feedback compensating value of the air fuel ratio obtained during the air fuel ratio feedback control is outside a normal value range. Then, the system warns the driver of the abnormality.

In recent years, direct cylinder injection type engines have become popular. A combustion controller for such engine selects different combustion modes to improve fuel efficiency. The combustion mode is selected from stoichiometric combustion, in which the air fuel mixture is stoichiometric, and lean combustion, in which the air fuel mixture is more lean than the stoichiometric state. Lean combustion is performed when the operating state of the engine is stable.

For accurate detection of abnormalities, the engine must be in a stable operating state for a certain time period. Lean combustion is commenced when the engine enters such stable operating state. The air fuel ratio is feedback controlled during stoichiometric combustion, and abnormalities of the fuel supply system are detected during the feedback control. Thus, it is difficult to detect abnormalities in the fuel supply system when the engine is in a stable operating state.

Accordingly, lean combustion may be prohibited when checking for abnormalities in the fuel supply system. However, this would lower fuel efficiency.

SUMMARY OF THE INVENTION

It is an object of the present invention to provide an apparatus for controlling combustion in an engine that accurately and easily detects an abnormality in the fuel supply system.

To achieve the above object, the present invention provides a combustion controller of an engine having a fuel supply system for supplying fuel. The combustion controller selects a combustion mode performed by the engine from either one of lean combustion, in which an air fuel mixture leaner than a stoichiometric mixture is burned, and stoichiometric combustion, in which a stoichiometric mixture is burned, in accordance with an operating state of the engine, and feedback controls the air fuel ratio of the air fuel mixture when the stoichiometric combustion is performed using an air fuel ratio feedback compensating value, which is set in accordance with a component concentration in an exhaust gas. The controller includes a preliminary testing means for testing the fuel supply system and determining that the fuel supply system is in a normal state when one of a plurality of predetermined first conditions is satisfied. The first conditions include a condition using the variable feedback compensating value. A lean combustion prohibiting means prohibits the lean combustion when the preliminary testing means determines that the state of the fuel supply system is ambiguous. A main testing means tests the fuel supply system and determines that the fuel supply system is in an abnormal state when one of a plurality of predetermined second conditions is satisfied. The second conditions include a condition using the variable feedback compensating value.

A further aspect of the present invention provides a method for controlling combustion in an engine, which has a fuel supply system for supplying fuel, by selecting a combustion mode performed by the engine from either one of lean combustion, in which an air fuel mixture leaner than a stoichiometric air fuel mixture is burned, and stoichiometric combustion, in which a stoichiometric air fuel mixture is burned, in accordance with an operating state of the engine, and feedback controlling an air fuel ratio of the air fuel mixture when the stoichiometric combustion is performed. The method includes setting an air fuel ratio feedback compensating value in accordance with a component concentration in an exhaust gas when executing feedback control during stoichiometric combustion, and preliminarily testing the fuel supply system and determining that the fuel supply system is in a normal state when one of a plurality of predetermined first conditions is satisfied. The first conditions include a condition using the feedback compensating value. The method further includes prohibiting the lean combustion when the state of the fuel supply system is determined to be ambiguous in the preliminary testing step, and main testing the fuel supply system and determining that the fuel supply system is in an abnormal state when one of a plurality of predetermined second conditions is satisfied. The second conditions include a condition using the feedback compensating value.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
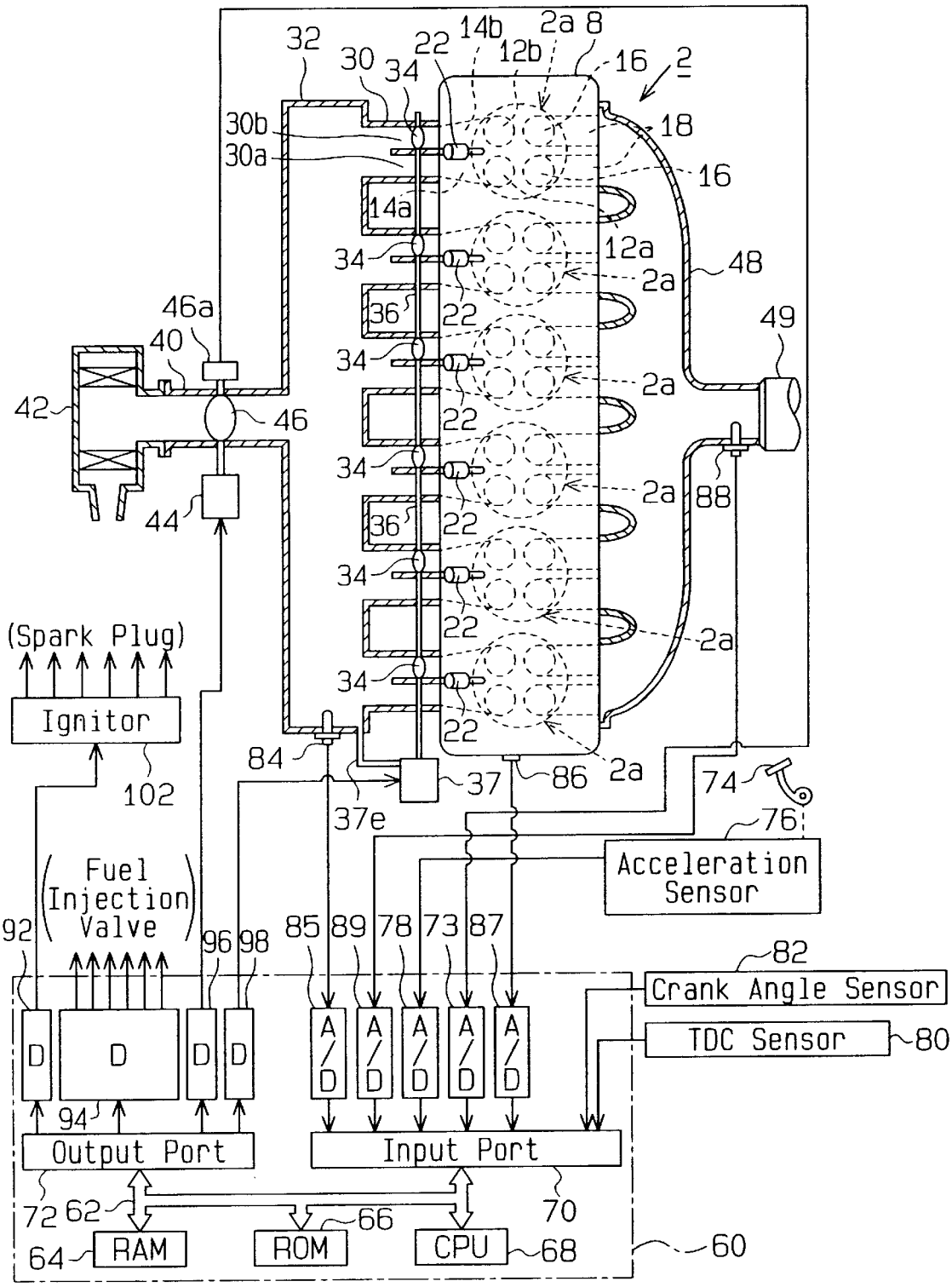
FIG. 1 is a schematic block diagram showing an engine incorporating a combustion controller according to the present invention.
Figure 5:
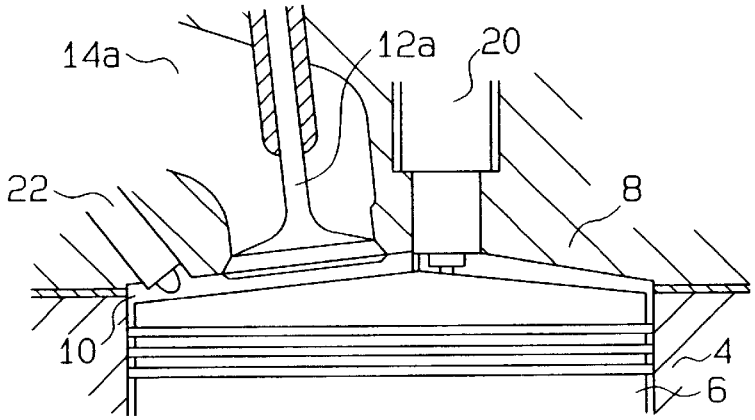
FIG. 5 is a cross-sectional view taken along line 5—5 in FIG. 2.

FIG. 1 shows a direct cylinder injection type gasoline engine 2, which incorporates a combustion controller according to the present invention. The engine 2 is installed in an automobile and has six cylinders 2*a*. As shown in FIG. 5, each of the cylinders 2*a* has a combustion chamber 10 defined by a cylinder block 4, a piston 6, and a cylinder head 8, which is mounted on the cylinder block 4.

A first intake valve 12*a*, a second intake valve 12*b*, and a pair of exhaust valves 16 are arranged in each combustion chamber 10. The first intake valve 12*a* is connected to a first intake port 14*a*, the second intake valve 12*b* is connected to a second intake port 14*b*, and the two exhaust valves 16 are connected to two exhaust ports 18, respectively.

Figure 2:
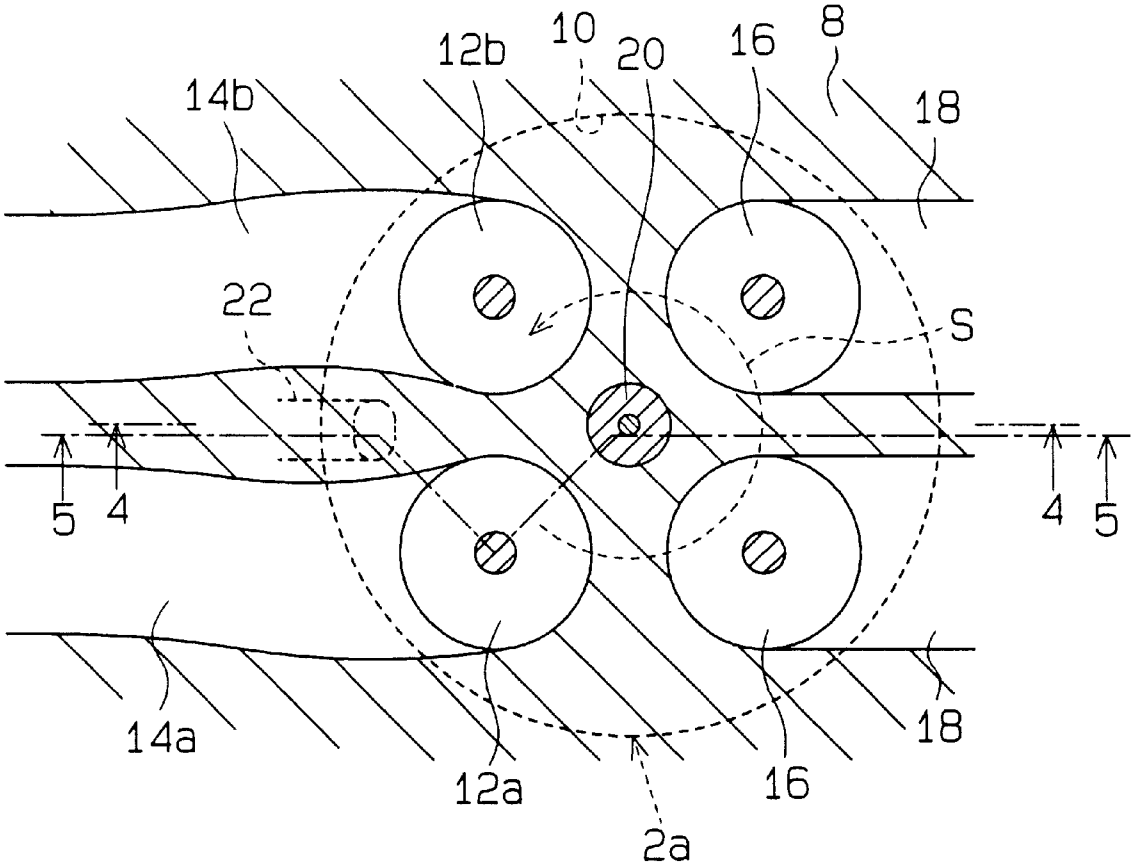
FIG. 2 is a partial cross-sectional plan view showing a cylinder head of the engine of FIG. 1.

With reference to FIG. 2, which is a cross-sectional plan view showing the cylinder head 8, the first and second intake ports 14*a*, 14*b* extend in a relatively straight manner. A spark plug 20 is arranged on the inner wall of the cylinder head 8 at the center of the combustion chamber 10. A fuel injection valve 22 is located in the vicinity of the first intake valve 12*a* and the second intake valve 12*b* to inject fuel directly into the combustion chamber 10.

Figure 3:
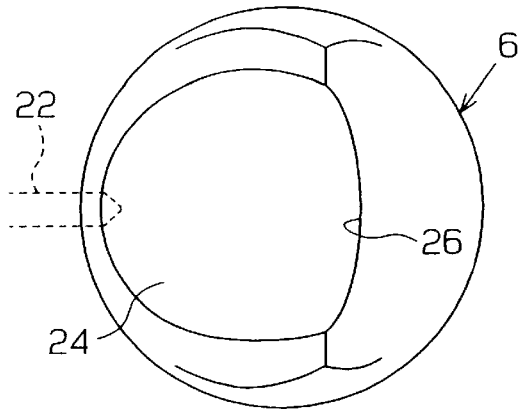
FIG. 3 is a plan view showing the top of a piston of FIG. 1.
Figure 4:
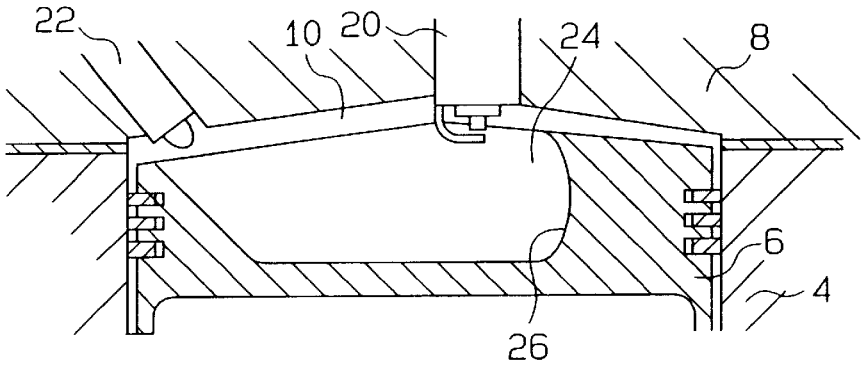
FIG. 4 is a cross-sectional view taken along line 4—4 in FIG. 2.

Referring to FIGS. 3 to 5, the top of the piston 6, which is generally conical, includes a concave portion 24 having a dome-like cross-section. The concave portion 24 extends from a position below the fuel injection valve 22 to a position below the spark plug 20.

As shown in FIG. 1, the first intake port 14*a* of each cylinder 2*a* is connected to a surge tank 32 via a first intake passage 30*a* extending through an intake manifold 30. The second intake port 14*b* of each cylinder 2*a* is connected to the surge tank 32 via a second intake passage 30*b* extending through the intake manifold 30. A current control valve 34 is arranged in each second intake passage 30*b*. The current control valves 34 are each connected to a common shaft 36. An actuator 37 drives the shaft 36 and operates the current control valves 34. When the current control valves 34 are closed, intake air is drawn through only the first intake ports 14*a*. This produces a strong swirling current S in the associated combustion chamber 10 (FIG. 2).

The surge tank 32 is connected to an air cleaner 42 by an intake duct 40. A throttle valve 46 driven by a motor 44 (DC motor or stepping motor) is located in the intake duct 40. The opened amount of the throttle valve 46 (throttle angle TA) is detected by a throttle sensor 46*a* and controlled in accordance with the engine operating state. The exhaust ports 18 of each cylinder 2*a* are connected to an exhaust manifold 48. The exhaust manifold 48 is connected to a catalytic converter 49 for purifying the exhaust gas.

A fuel distribution pipe (not shown) is arranged on the cylinder head 8 near the first and second intake valves 12*a*, 12*b*. The fuel distribution pipe is connected to the fuel injection valves 22. When performing stratified charge combustion and homogeneous charge combustion, the fuel injection valves 22 directly inject the fuel supplied from the fuel distribution pipe into associated ones of the combustion chambers 10. A high pressure fuel pump (not shown) sends highly pressurized fuel to the fuel distribution pipe.

An electronic control unit (ECU) 60, which is a digital computer or processor, includes a random access memory (RAM) 64, a read only memory (ROM) 66, a microprocessor or a central processing unit (CPU) 68, an input port 70, and an output port 72, which are connected to one another by a bidirectional bus 62.

The throttle sensor 46*a*, which detects the throttle angle TA, provides the ECU 60 with an output voltage proportional to the detected throttle angle TA via an analog to digital or A/D converter 73. An acceleration sensor 76 attached to an acceleration pedal 74 provides the ECU 60 with a voltage proportional to the depressed amount of the acceleration pedal 74 via an A/D converter 78. A top dead center sensor 80 generates, for example, an output pulse when the piston 6 in the first cylinder 2*a* reaches the top dead center position during the intake stroke and provides the output pulse to the ECU 60. A crank angle sensor 82 generates an output pulse whenever a crankshaft is rotated by 30 degrees and provides the output pulse to the ECU 60. The CPU 68 calculates the present crank angle from the output pulses of the top dead center and crank angle sensors 80, 82. Further, the CPU 68 calculates the engine speed NE from the frequency of the output pulses generated by the crank angle sensor 82. An intake pressure sensor 84 detects the intake pressure PM (absolute pressure) of the surge tank 32 and provides a corresponding output signal to the ECU 60 via an A/D converter 85. A coolant temperature sensor 86 is arranged on the cylinder block 4 to detect the coolant temperature THW of the engine 2 and provide a corresponding output signal to the ECU 60 via an A/D converter 87. An air fuel ratio sensor 88 is arranged on the exhaust manifold 48 and provides an output signal corresponding to the air fuel ratio to the ECU 60 via an AC converter 89.

An ignitor 102, the fuel injection valves 22, the throttle valve motor 44, and the actuator 37 are connected to the output port 72 by respective drive circuits 92, 94, 96, and 98. The ignitor 102, fuel injection valves 22, throttle valve motor 44, and actuator 37 are driven in accordance with signals sent from the associated drive circuits 92, 94, 96, 98.

Fuel injection control performed after the starting of the engine 2 will now be discussed.

Figure 6:
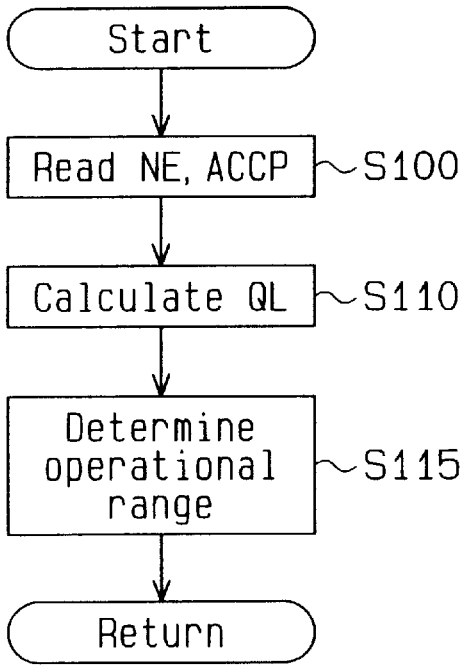
FIG. 6 is a flowchart showing a routine for setting an operational range.

When commencing the fuel injection control, an operational range is determined through the routine of FIG. 6. The routine is executed at predetermined crank angle positions.

At step S100, the engine speed NE, which is obtained from the signal of the crank angle sensor 82, and the depressed amount of the acceleration pedal 74, or the acceleration pedal depression ACCP, which is obtained from the acceleration sensor 76, are read by the ECU 60 and stored in the RAM 64.

Figure 7:
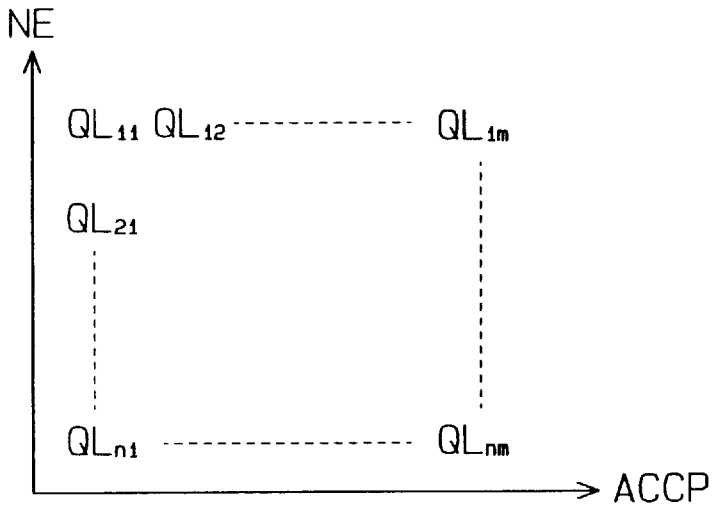
FIG. 7 is a graph showing a map used to obtain lean fuel injection amount QL.

Then, at step S110, the ECU 60 determines a lean fuel injection amount QL based on the engine speed NE and the acceleration pedal depression ACCP. The lean fuel injection amount QL represents the optimal fuel injection amount for matching the output torque of the engine 2 with the required torque when performing stratified charge combustion. The lean fuel injection amount QL is obtained from a map (FIG. 7), the parameters of which are the acceleration pedal depression ACCP and the engine speed NE. The map of FIG. 7 is obtained experimentally and stored in the ROM 66. Since values are dispersed throughout the map, a value corresponding to the parameters read by the RAM 64 may not exist on the map. In this case, QL is calculated through interpolation. Such interpolation is also carried out when referring to maps other than that of FIG. 7.

Figure 8:
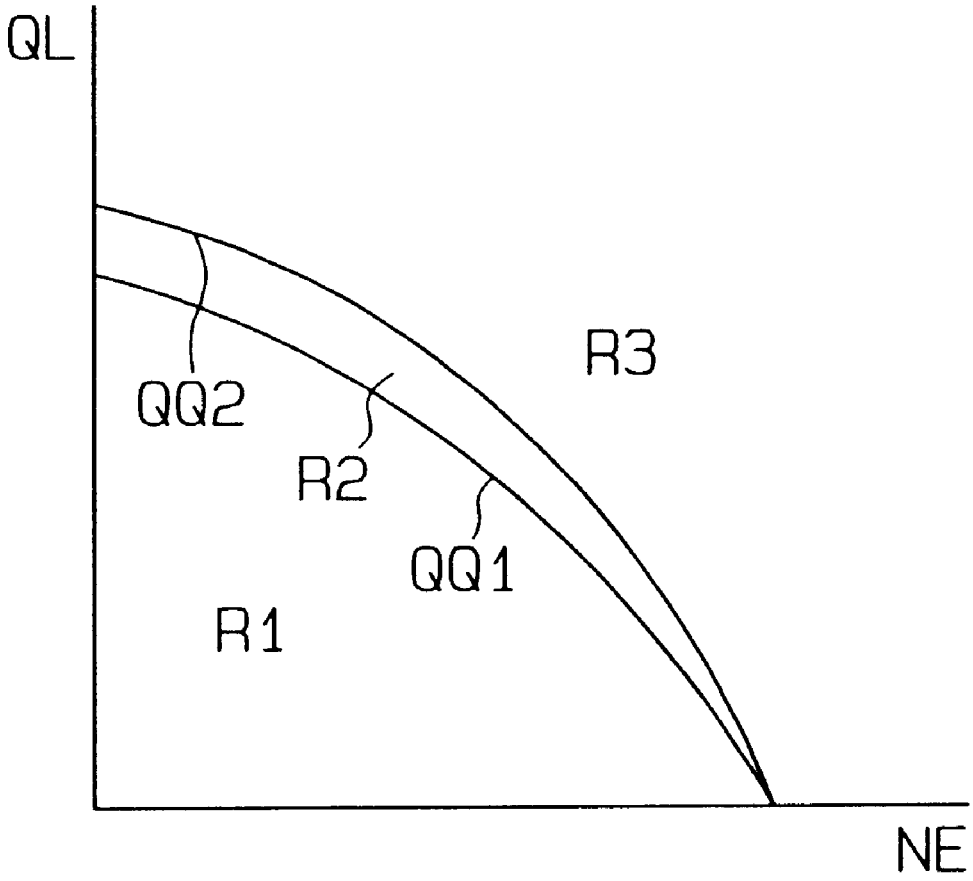
FIG. 8 is a graph showing a map used to set an operational range.

At step S115, based on the lean fuel injection amount QL and the engine speed NE, the ECU 60 determines three operational ranges R1, R2, R3, which are shown in FIG. 8. The operational ranges R1, R2, R3 are defined by a first threshold value QQ1 and a second threshold value QQ2. The routine is then temporarily terminated.

Figure 9:
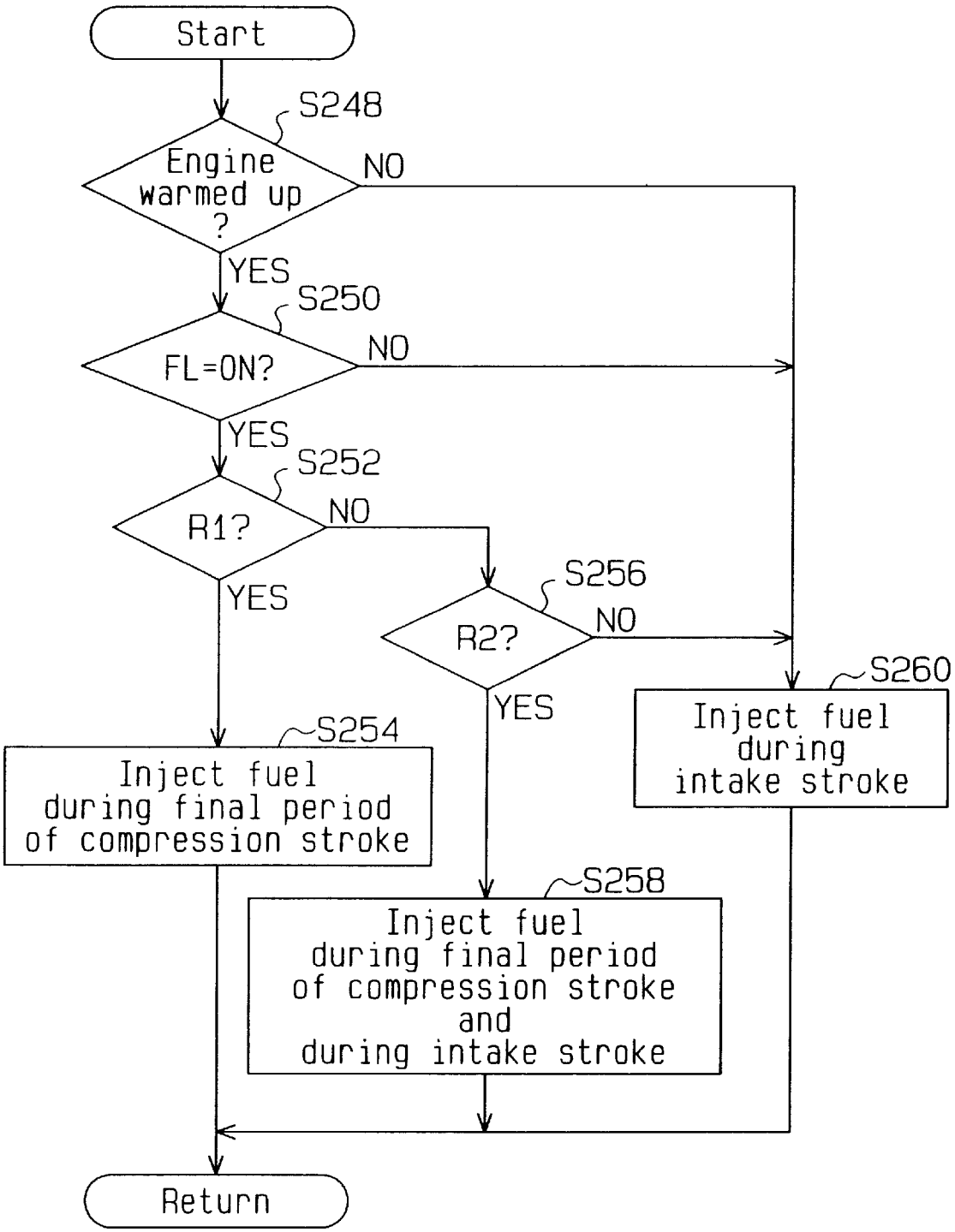
FIG. 9 is a flowchart showing a routine for controlling fuel injection timing.

After determining the operational ranges R1, R2, R3, the ECU 60 executes a routine illustrated in the flowchart of FIG. 9 to control the fuel injection timing in accordance with the operational ranges R1–R3. The routine is executed at predetermined crank angle positions.

At step S248, the ECU 60 determines whether or not the engine 2 has been warmed up. If the coolant temperature THW exceeds about 78° C., the ECU 60 determines that the engine 2 has been warmed up. If the engine 2 has been warmed, the ECU 60 proceeds to step S250.

Figure 15:
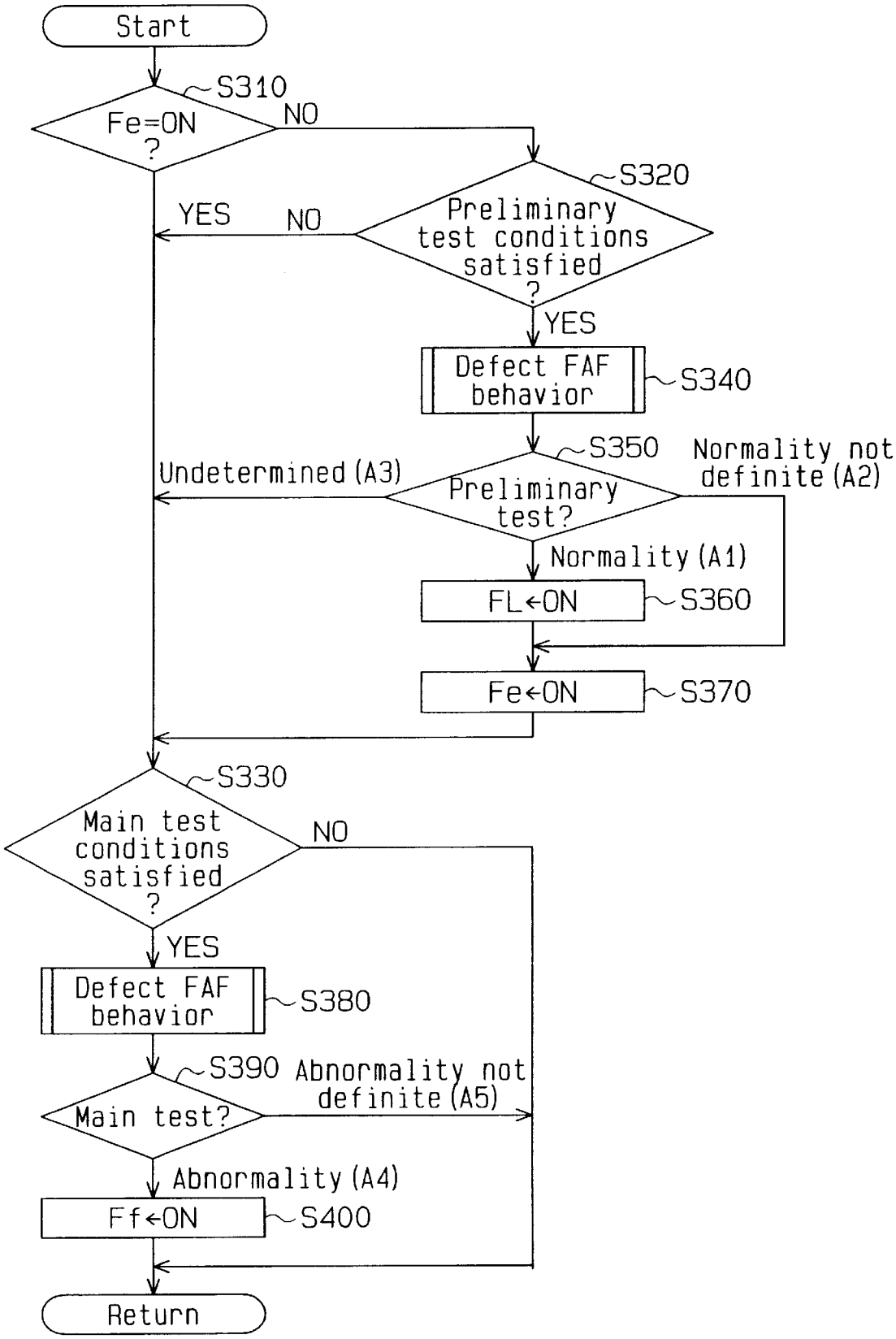
FIG. 15 is a flowchart showing a routine for testing the fuel supply system.

At step S250, the ECU 60 determines whether or not a permission flag FL, which permits switching of the combustion mode to lean combustion, is ON. The permission flag FL is set in a routine for testing the fuel supply system, which is shown in FIG. 15. If the permission flag is ON in step S250, the ECU 60 proceeds to step S252 and determines whether or not the present operating state of the engine 2 is in the operational range R1.

If the present engine operating state is in the operational range R1, that is, if the lean fuel injection amount QL is less than the first threshold value QQ1, the ECU 60 proceeds from step S252 to step S254. At step S254, the ECU 60 sets the fuel injection timing so that an amount of fuel corresponding to the lean fuel injection amount QL is injected during the final period of the compression stroke. The lean fuel injection amount QL is set so that the ratio between the intake air and the lean fuel injection amount QL in each combustion chamber 10 is less than the stoichiometric air fuel ratio. The fuel injected during the final period of the compression stroke enters the concave portion 24 of the piston 6 hitting a peripheral wall 26 (FIGS. 3 and 4) formed about the concave portion 24. The fuel is gasified as it flows along the peripheral wall 26 thereby forming a layer of combustible air fuel mixture in the vicinity of the associated spark plug 20. The combustible mixture layer is then ignited by the spark plug 20 to perform stratified charge combustion.

If the engine operating state is not in the operational range R1 in step S252, the ECU 60 proceeds to step S256 and determines whether the present engine operating state is in the operational range R2. The operational range R2 is the range of the lean fuel injection amount QL between the first threshold value QQ1 and the second threshold value QQ2.

If the present engine operating state is in the operational range R2 in step S256, the ECU 60 proceeds to step S258 and sets the fuel injection timing so that fuel is injected twice, once during the intake stroke and once during the final period of the compression stroke. The total amount of the injected fuel during the two injections corresponds to the lean fuel injection amount QL. The lean fuel injection amount QL is less than the amount of fuel when the air fuel ratio in the combustion chamber 10 is stoichiometric. The fuel of the first injection during the intake stroke enters the associated combustion chamber 10 together with intake air and forms a homogeneous lean air fuel mixture in the combustion chamber 10. The fuel of the second injection during the compression stroke forms a layer of combustible air fuel mixture in the concave portion 24 at the vicinity of the spark plug 20. The combustible mixture layer is ignited by the spark plug 20. This burns the lean mixture, which is spread throughout the combustion chamber 10. In other words, when in the operational range R2, stratified charge combustion is performed at a lower level of stratification than in the operational range R1.

If the present engine operating state is not included in the operational range R2 in step S250, the operating state is included in the operational range R3. In this case, the ECU 60 proceeds to step S260 and sets the fuel injection timing and the fuel injection amount so that fuel, the amount of which has been compensated for in accordance with a basic fuel injection amount QBS (described later), is injected during the intake stroke. In this case, fuel enters each combustion chamber 10 together with the intake air and forms a homogeneous and stoichiometric air fuel mixture in the entire combustion chamber 10 to perform homogeneous charge combustion. However, when step S260 is performed, the fuel injection amount may be controlled so that incremental compensation of the injection amount causes the air fuel mixture to be richer than a stoichiometric mixture (described later).

If it is determined that the engine 2 has not been warmed up in step S248, the ECU 60 proceeds to step S260 and sets the fuel injection timing and amount so that fuel, the amount of which has been compensated for in accordance with the basic fuel injection amount QBS, is injected during the intake stroke in the same manner as when the engine operating state is in the operational range R3.

After setting the fuel injection mode through steps S254, S258, S260, the ECU 60 terminates the routine of FIG. 9.

Figure 10:
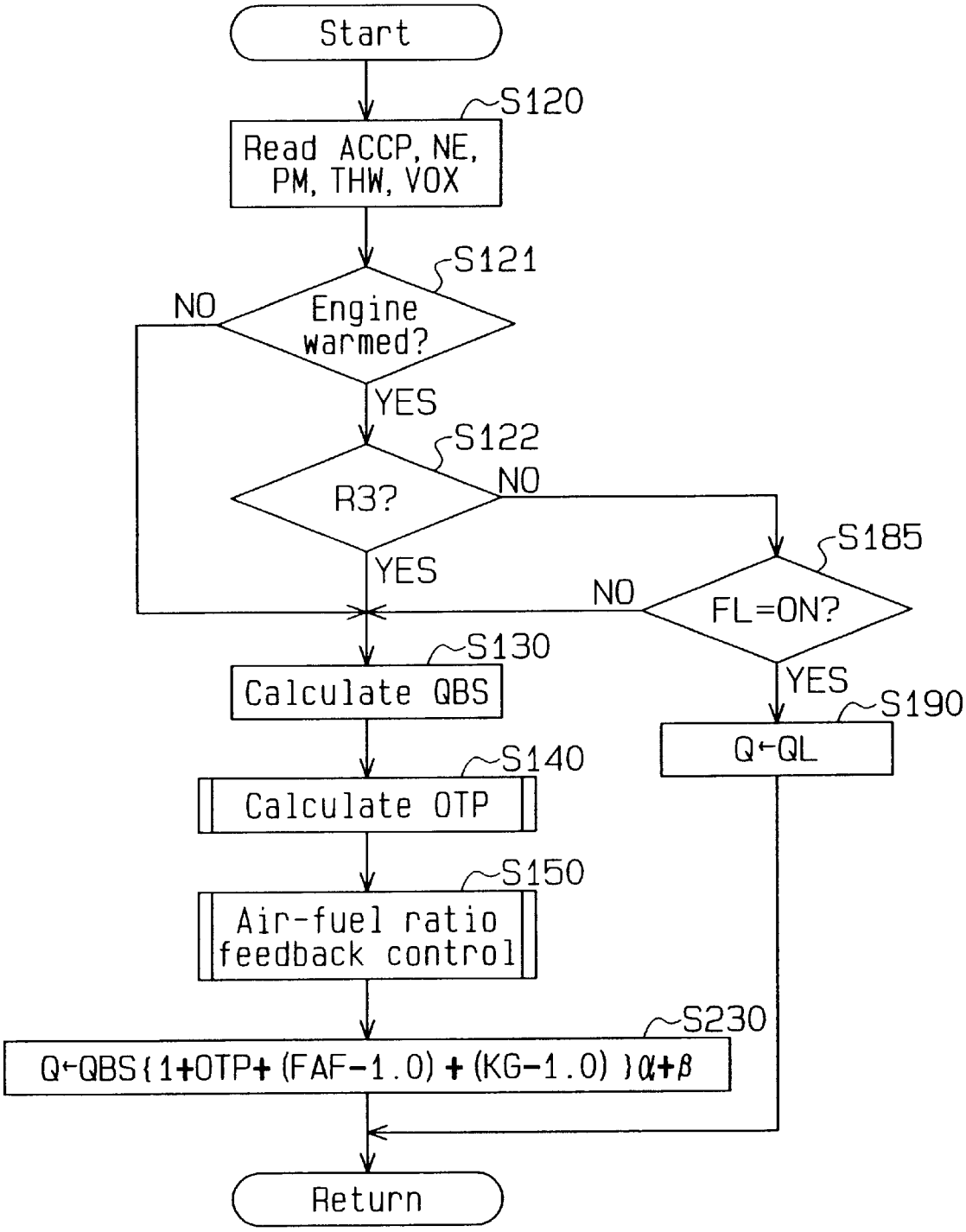
FIG. 10 is a flowchart showing a routine for controlling fuel injection amount.

A routine for controlling the fuel injection amount in accordance with the operational range set in the routine of FIG. 6 is shown in the flowchart of FIG. 10. The routine is executed at predetermined crank angle positions.

At step S120, the ECU 60 reads the acceleration pedal depression ACCP, the engine speed NE, the intake pressure PM, the coolant temperature THW, and an output voltage value Vox of the output signal of the air fuel ratio sensor 88.

Figure 11:
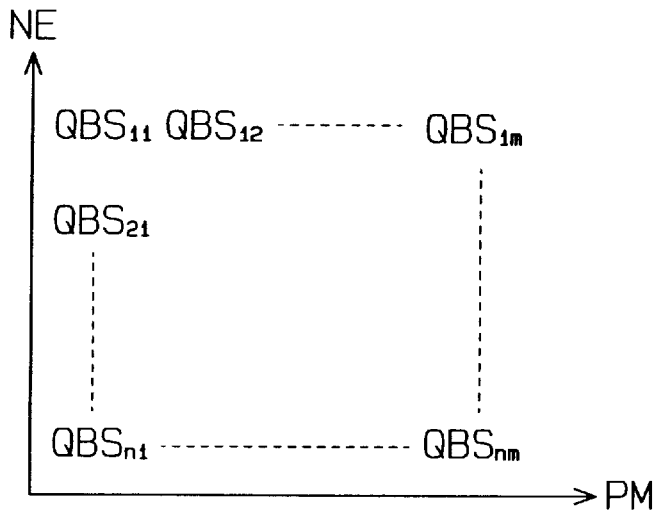
FIG. 11 is a graph showing a map used to obtain a basic fuel injection amount QBS.

At step S121, the ECU 60 determines whether or not the engine 2 has been warmed up. If the engine 2 has been warmed up, that is, if the coolant temperature THW exceeds about 78° C., the ECU 60 proceeds from step S121 to step S122 and determines whether or not the operational range R3 was set in the routine of FIG. 6. If it is determined that the operational range R3 was set, the ECU 60 proceeds from step S122 to step S130 and obtains a stoichiometric basic fuel injection amount QBS using the map of FIG. 11, which is stored in the ROM 66.

Figure 12:
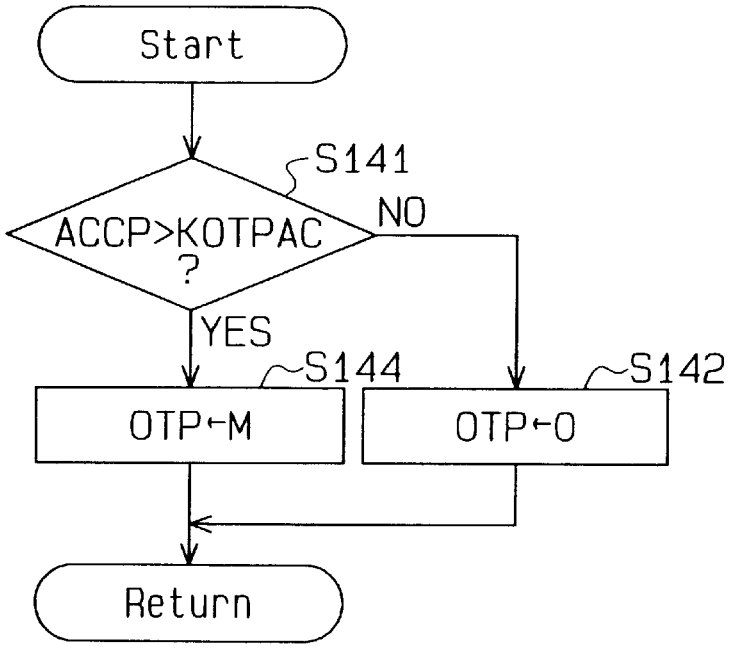
FIG. 12 is a flowchart showing a routine for calculating a large load increase.

At step S140, the ECU 60 executes a routine shown in FIG. 12 for calculating a large load increase OTP.

When entering the routine of FIG. 12, the ECU 60 first performs step S141 and determines whether or not the acceleration pedal depression ACCP is greater than a large load reference value KOTPAC. If the acceleration pedal depression ACCP is less than or equal to the large load reference value KOTPAC., the ECU 60 proceeds from step S141 to step S142 and sets the large load increase OTP to zero. The ECU 60 then temporarily terminates the routine. In this case, the fuel amount is not compensated for in an incremental manner.

If it is determined that the acceleration pedal depression ACCP is greater than the large load reference value KOTPAC in step S141, the ECU 60 proceeds to step S144 and sets the large load increase OTP to a predetermined value M (e.g., 1>M>0). In this case, the fuel amount is compensated for in an incremental manner. The incremental fuel compensation prevents the catalytic converter 49 from overheating when a high load is applied.

Figure 13:
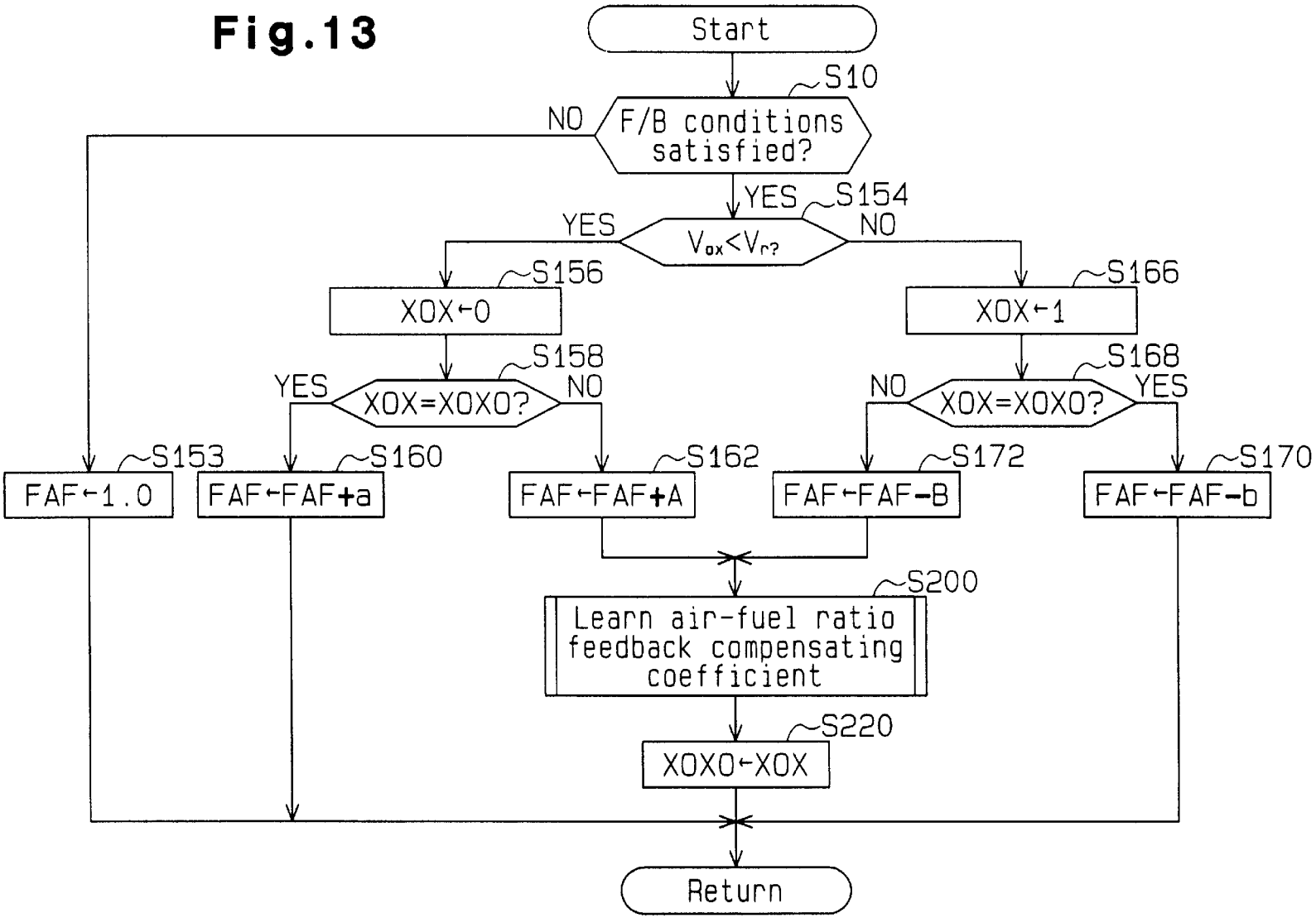
FIG. 13 is a flowchart showing a routine for feedback controlling the air fuel ratio.

After obtaining the high load increase OTP, the ECU 60 proceeds to step S150 of FIG. 10 and executes a routine shown in FIG. 13 for controlling the air fuel ratio.

When entering the routine of FIG. 13, the ECU 60 first performs step S152 and determines whether the requirements for executing air fuel ratio feedback control are satisfied. The requirements are, for example, as follows:

(1) the engine 2 having been cranked;

(2) fuel cut not being performed;

(3) the air fuel ratio sensor 88 being activated; and (4) other prerequisites If any one of the requirements is not satisfied, the ECU 60 does not execute the air fuel ratio control and proceeds from step S152 to step S153 to set a feedback compensation coefficient FAF to 1.0. Afterward, the ECU 60 temporarily terminates the routine.

If all of the requirements are satisfied in step S152, the ECU 60 proceeds to step S154 to execute the air fuel ratio control. At step S154, the ECU 60 determines whether the output voltage value Vox of the air fuel ratio sensor 88 is smaller than a reference voltage Vr (e.g., 0.45V). If the output voltage value Vox is smaller than the reference voltage Vr, the air fuel ratio corresponds to a lean air fuel mixture. In this case, the ECU 60 proceeds to step S156 and resets an air fuel ratio flag XOX to zero.

At step S158, the ECU 60 determines whether or not the air fuel ratio flag XOX is the same as a previous air fuel ratio flag XOXO. If the air fuel ratio flag XOX is the same as the previous air fuel ratio flag XOXO, this indicates that a lean state has been continuing. In this case, the ECU 60 proceeds to step S160 and adds a lean integral amount a (a>0) to the feedback compensation coefficient FAF. The ECU 60 then temporarily terminates the routine of FIG. 13.

If the air fuel ratio flag XOX is not the same as the previous air fuel ratio flag XOXO in step S158, this indicates that the air fuel ratio has changed from a rich state to a lean state. In this case, the ECU 60 proceeds to step S162 and adds a lean skip amount A (A>0) to the feedback compensation coefficient FAF. The lean skip amount A is significantly greater than the lean integral amount a. The ECU 60 then proceeds to step S200 and executes the routine of FIG. 14.

When the output voltage value Vox of the air fuel ratio sensor 88 is greater than or equal to the reference voltage Vr in step S154, the air fuel ratio corresponds to a rich air fuel mixture. In this case, the ECU 60 proceeds to step S166 and sets the air fuel ratio flag XOX to one. At step S168, the ECU 60 determines whether or not the air fuel ratio flag XOX is the same as the previous air fuel ratio flag XOXO.

If the air fuel ratio flag XOX is the same as the previous air fuel ratio flag XOXO, this indicates that a rich state has been continuing. In this case, the ECU 60 proceeds to step S170 and subtracts a lean integral amount b (b>0) from the feedback compensation coefficient FAF. The ECU 60 then temporarily terminates the routine of FIG. 13.

If the air fuel ratio flag XOX is not the same as the previous air fuel ratio flag XOXO in step S168, this indicates that the air fuel ratio has changed from a lean state to a rich state. In this case, the ECU 60 proceeds to step S172 and subtracts a lean skip amount B (B>0) from the feedback compensation coefficient FAF. The lean skip amount B is significantly greater than the lean integral amount b. The ECU 60 then proceeds to step S200 and executes the routine of FIG. 14.

The routine of FIG. 14 for generating the feedback compensation coefficient will now be discussed.

At step S202, the ECU 60 determines whether or not the engine 2 has been warmed up, that is, whether or not the coolant temperature THW exceeds about 78° C.

If the engine 2 has not been warmed in step S202, the ECU 60 exits the generating routine.

If the engine 2 has been warmed, the ECU 60 proceeds from step S202 to step S204 and calculates an average value FAFAV of a stored previous feedback compensating coefficient FAFB and the present feedback compensating coefficient FAF. Formula (1) is used to calculate the average value FAFAV.

$$FAFAV=(FAFB+FAF)/2 \quad (1)$$

At step S206, the ECU 60 updates the previous feedback compensating coefficient FAFB. That is, the present feedback compensating coefficient FAF is stored as the previous feedback compensating coefficient FAFB.

At step S208, the ECU 60 compares the average value FAFAV with the value of 0.98. If the average value FAFAV is less than 0.98, the ECU 60 proceeds to step S210 and subtracts a fluctuation amount γ (γ>0) from a compensating coefficient learned value KG. The ECU 60 then terminates the routine of FIG. 14.

If the average value FAFAV is greater than or equal to 0.98 in step S208, the ECU 60 proceeds to step S212 and compares the average value FAFAV with the value of 1.02. If the average value FAFAV is greater than 1.02, the ECU 60 proceeds to step S214 and adds the fluctuation amount γ (γ>0) to the compensating coefficient learned value KG. The ECU 60 then temporarily terminates the routine.

When the average value FAFAV is greater than or equal to 0.98 (step S208) and less than or equal to 1.02 (step S212), the correction coefficient learned value KG is not updated and remains the same. In this case, the ECU 60 temporarily terminates the routine of FIG. 14.

The compensating coefficient learned value KG is set for each of the operational ranges, which are defined in accordance with the operating state of the engine 2. Hence, there is a plurality of learned values KG. Accordingly, the compensating coefficient learned value KG corresponding to the operational state of the engine is used when performing calculations and routines involving the compensating coefficient learned value KG.

Figure 14:
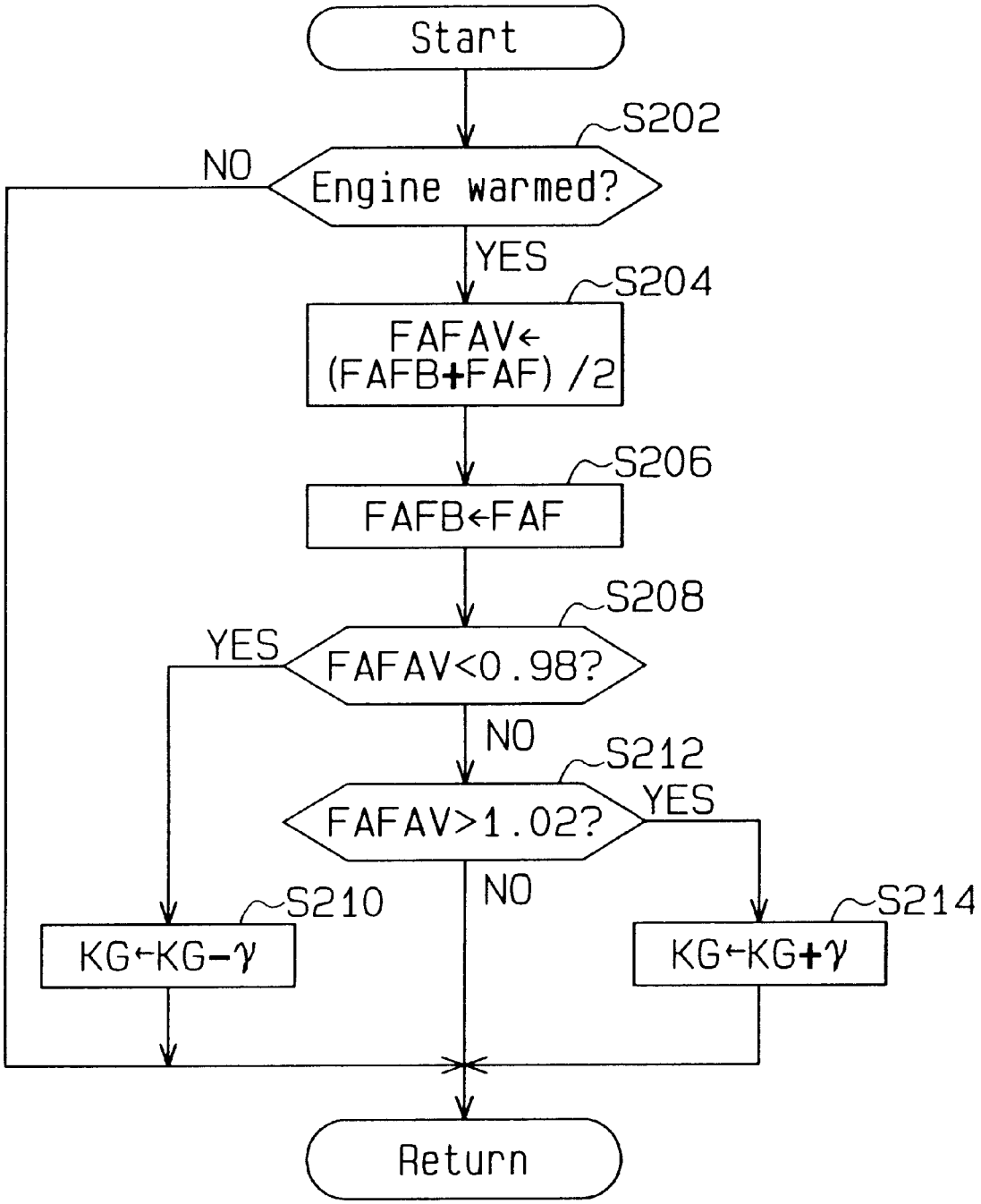
FIG. 14 is a flowchart showing a routine for generating a compensating coefficient.

After completing the routine of FIG. 14, the ECU 60 proceeds to step S220 of FIG. 13 and saves the air fuel ratio flag XOX as the previous air fuel ratio flag XOXO. The ECU 60 then temporarily terminates the routine of FIG. 13.

This completes step S150 of FIG. 10. The ECU 60 then proceeds to step S230 of FIG. 10 and calculates a fuel injection amount Q in accordance with formula (2). The ECU 60 then terminates the routine of FIG. 10.

$$Q=QBS\{1+OTP+(FAF-1.0)+(KG-1.0)\}\alpha+\beta \quad (2)$$

In the formula, $\alpha$ and $\beta$ each represent coefficients that are varied in accordance with the type of engine and control.

If the engine operating state is in a range other than the operational range R3, that is, if the engine operating state is in either one of the operational ranges R1, R2 in which lean combustion is performed, the ECU 60 proceeds from step S122 to step S185 and determines whether or not the permission flag FL is ON. The permission flag FL is set in a routine for testing the fuel supply system (described later), which is shown in FIG. 15.

If the permission flag FL is ON in step S185, the ECU 60 proceeds to step S190 and sets the lean fuel injection amount QL, which is obtained at step S110 of the routine for setting the operational range (FIG. 6), as the fuel injection amount Q. The ECU 60 then terminates the routine.

When the permission flag FL is OFF in step S185, lean combustion is prohibited regardless of the engine operating state being included in operational ranges R1 or R2. In this case, the ECU 60 performs the steps S130, S140, S150 and S230 to perform stoichiometric combustion.

A routine for testing the fuel supply system will now be discussed with reference to the flowchart of FIG. 15. The routine is executed cyclically at predetermined intervals.

When entering the routine, at step S310, the ECU 60 determines whether a preliminary test completion flag Fe is ON. The preliminary test completion flag Fe is initialized and set at OFF when the engine 2 is started.

If the preliminary test completion flag Fe is OFF in step S310, the ECU 60 proceeds to step S320 and determines whether or not the requirements for performing a preliminary test are satisfied. The preliminary test requirements include those for executing the air fuel ratio feedback control (step S152 of FIG. 13) and a requirement requiring that the operating state of the engine 2 is not in a transitional period. However, the requirements do not include the engine 2 having been warmed up.

If the requirements for performing the preliminary test are not satisfied in step S320, the ECU proceeds to step S330 and determines whether or not the requirements for performing a main test are satisfied. The main test requirements include the requirements for executing the air fuel ratio feedback control (step S152 of FIG. 13) and the requirement that the operating state of the engine 2 is not in a transitional period. Unlike the preliminary test requirements, the main test requirements further include the engine 2 having been warmed up. Accordingly, the preliminary test requirements are more lenient than the main test requirements.

If the conditions for performing the main test are not satisfied in step S330, the ECU 60 temporarily terminates the routine.

When the preliminary test completion flag Fe is OFF and neither of the conditions of the preliminary and main tests are satisfied, the ECU 60 keeps repeating steps S310, S320, S330.

While the ECU 60 repeats steps S310, S320, S330, for example, if the engine 2 has been cranked and the air fuel ratio feedback control for stoichiometric combustion is commenced when the engine 2 is being warmed up, the preliminary test conditions become satisfied. In this case, the ECU 60 proceeds from step S320 to step S340 and performs a routine shown in FIG. 16 for detecting the behavior of the fuel compensating coefficient FAF.

Figure 16:
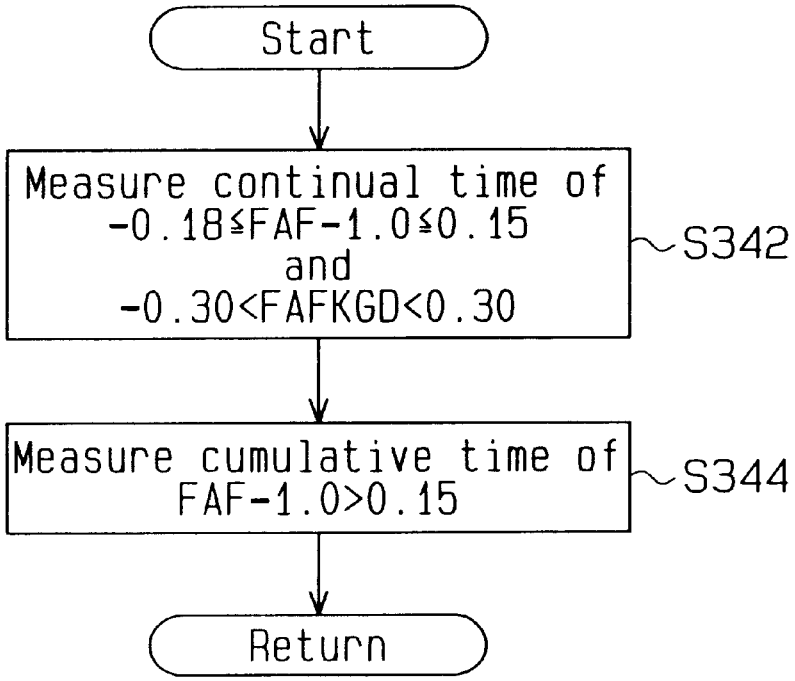
FIG. 16 is a flowchart showing a routine for detecting the behavior of a feedback compensating value FAF in a preliminary test.

The routine of FIG. 16 will now be described.

When entering the routine, at step S342, the ECU 60 measures the time during which the feedback compensating coefficient FAF satisfies formula (3)(FAF normality range) while a total behavior value FAFKGD satisfies formula (4) (FAFKGD normality range).

$$-0.18 \leqq FAF-1.0 \leqq 0.15 \quad (3)$$

$$-0.30 < FAFKGD < 0.30 \quad (4)$$

The total behavior value FAFKGD is calculated using formula (5) and represents the behavior when the feedback compensating coefficient FAF and the compensating coefficient learned value KG are added.

$$FAFKGD=FAF+KG-2.0 \quad (5)$$

In step S342, the total behavior value FAFKGD is obtained from weighted averages.

The compensating coefficient learned value KG differs from the feedback correction coefficient in that the learned value KG is not calculated when the engine 2 is being warmed up. Therefore, when the engine 2 is being warmed up, the previous compensation coefficient learned value KG stored in a backup RAM, which forms part of the RAM 64, is used.

At step S344, the cumulative time during which the feedback compensating coefficient FAF satisfies formula (6) (FAF abnormality range) is measured.

$$FAF-1.0>0.15 \quad (6)$$

The cumulative time refers to the cumulative time during which formula (6) is satisfied while performing step S342.

After the routine of step S340 is completed, the ECU 60 proceeds to step S350 of FIG. 15 and performs the preliminary test.

At step S350, the ECU 60 generates one of the following test results:

(A1) the fuel supply system is in a normal state;

(A2) the fuel supply system cannot be determined to be in a normal state; that is, the fuel supply system may have an abnormality; and (A3) test results A1 or A2 cannot be generated due to the lack of data.

The ECU 60 generates the test result A1 when any one of the following conditions (5) and (6) are satisfied:

(5) ten seconds (corresponding to required time for determining normality) elapsed when performing step S342; and (6) the coolant temperature THW exceeded 40° C. (corresponding to temperature determination value) when the engine 2 was started.

The ECU 60 generates the test result A2 when any one of the following conditions (7) and (8) are satisfied:

(7) conditions (5) and (6) are both not satisfied and thirty second (corresponding to required time for determining abnormality) elapsed when performing step S344; and (8) the fuel supply system has a history of being determined as having an abnormality during the main test (step S390 described later). That is, whether or not the fuel supply system was determined as having an abnormality during the period from when the engine 2 was started to the present time or during the previous operation of the engine 2.

When the conditions of the test results A1 and A2 are not satisfied, the ECU 60 generates the test result A3.

As long as the test result A3 is generated in the preliminary test, the ECU 60 proceeds from step S350 to step S330.

If the ECU 60 generates the test result A1 in the preliminary test (step S350), the ECU 60 proceeds from step S350 to step S360 and sets the permission flag FL, which permits the combustion mode to switch to lean combustion, to ON. Afterward, as long as the engine 2 is operated, the permission flag FL is determined as being ON in step S250 of the routine for controlling the fuel injection timing (FIG. 9) and in step S185 of the routine for controlling the fuel injection amount (FIG. 10). In this manner, lean stratified charge combustion is performed when the engine operating state is in operational range R1 or R2.

If the ECU 60 generates the test result A2 in the preliminary test (step S350), there may be an abnormality in the fuel supply system. Thus, in this case, the permission flag FL remains OFF subsequent to step S350. Afterward, as long as the engine 2 is operated, the permission flag FL is determined as not being ON in step S250 of the fuel injection control timing routine (FIG. 9) and in step S185 of the fuel injection amount control routine (FIG. 10). Accordingly, lean stratified charge combustion is not performed even when the engine operating state is in operational range R1 or R2. In this case, stoichiometric, homogeneous charge combustion is performed.

Then, at step S370, the ECU 60 sets the preliminary test completion flag Fe to ON and proceeds to step S330.

If the test results A1 or A2 are generated in the preliminary test (step S350), the preliminary test completion flag Fe is set to ON (step S370). Thus, in the next cycle, the preliminary test completion flag Fe is determined as being ON in step S310 and steps S320, S340, S350, S360, and S370 are not performed. The preliminary test completion flag Fe remains ON as long as the engine 2 continues operation. The next time the engine 2 is started, the preliminary test completion flag Fe is initialized and set at OFF.

Figure 17:
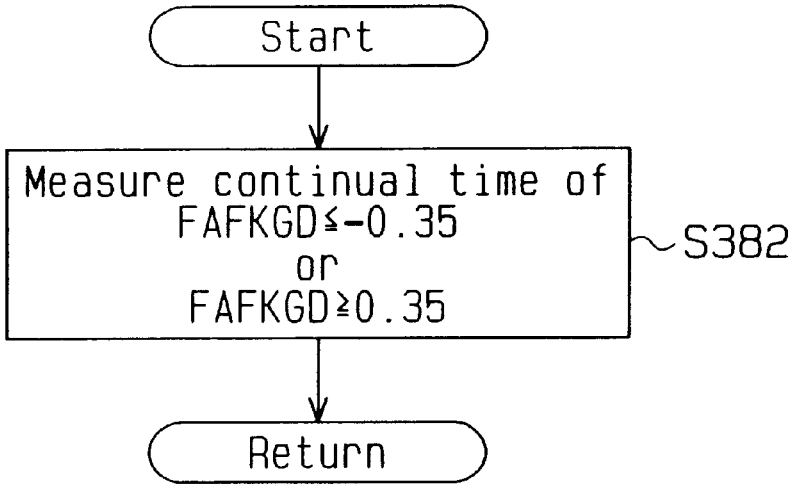
FIG. 17 is a flowchart showing a routine for detecting the behavior of the feedback compensating value FAF in a main test.

When the conditions for performing the main test are satisfied, the ECU 60 proceeds from step S330 to step S380 and executes a routine for detecting the behavior of the feedback compensating value FAF. The routine will now be discussed with reference to the flowchart of FIG. 17.

At step S382, the continual time during which the total behavior value FAFKGD satisfies either one of formulas (7) and (8) is measured.

$$FAFKGD \leqq -0.35 \quad (7)$$

$$FAFKGD \geqq 0.35 \quad (8).$$

After executing the routine for detecting the behavior of the feedback compensating value FAF in step S380, the ECU 60 proceeds to step S390 and performs the main test.

In the main test of step S350, the ECU 60 generates one of the following test results:

(A4) the fuel supply system has an abnormality; and (A5) the fuel supply system cannot be determined to have an abnormality.

The test result A4 is generated when the following condition (a2) is satisfied:

(a2) the time measured in step S382, during which either one of formulas (7) and (8) are satisfied, is six seconds or longer.

The test result A5 is generated when the test result A4 is not generated.

If the test result A4 is generated during the main test in step S390, it is determined that the fuel supply system has an abnormality. In this case, the ECU proceeds to step S400 and sets an abnormality flag Ff to ON (S400). The ECU 60 then temporarily terminates the routine. When the abnormality flag Ff is ON, data indicating abnormality in the fuel supply system is stored in the backup RAM of the RAM 64 and/or a warning lamp in front of the driver's seat is lit.

If the test result A5 is generated in step S390, the routine is temporarily terminated.

Accordingly, the fuel supply system is tested repetitively when the engine 2 is operating.

Figure 18:
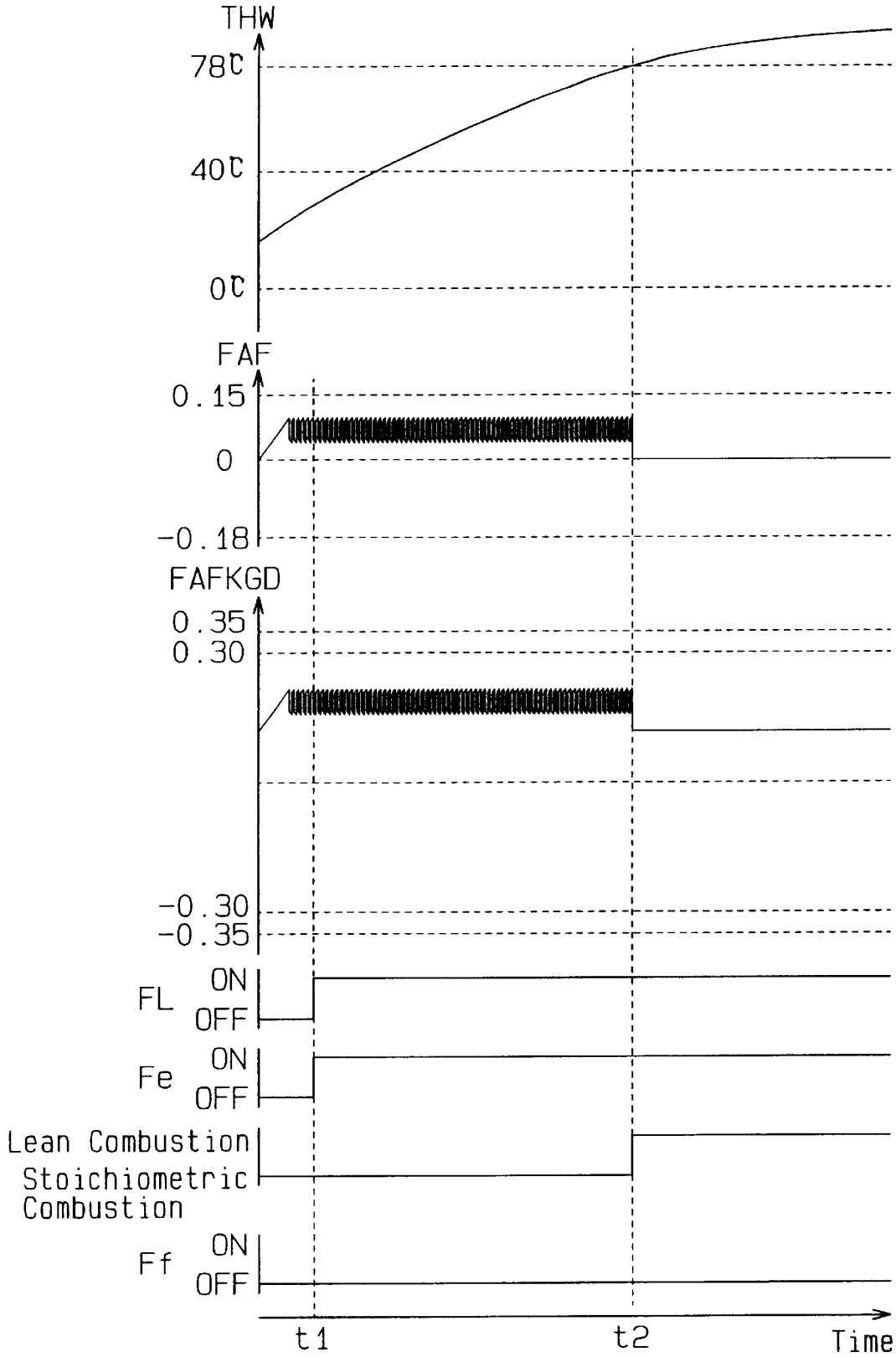
FIG. 18 is a timing chart showing a control example.

FIG. 18 is a timing chart of an example in which the fuel supply system is determined as functioning normally in the preliminary test (step S350) when the engine 2 is being warmed up. When the engine 2 is started, the coolant temperature THW is less than 40° C. At time t1, the formulas (3) and (4) of step S342 have been satisfied for ten seconds. At this time, the fuel supply system is determined to be functioning normally by the preliminary test. The permission flag FL is set to ON (step S360) and the preliminary test completion flag Fe is set to ON (S370).

As long as the engine 2 is operating, the preliminary test is not performed again. After the engine 2 is warmed at time t2, if the engine operating state is in either one of the operational ranges R1, R2, the permission flag FL is determined as being ON in step S250 of the routine for controlling the fuel injection timing (FIG. 9) and in step S185 of the routine for controlling the fuel injection amount (FIG. 10). Thus, lean, stratified charge combustion is performed (steps S254, S258). If the engine operating state shifts to the operational range R3, the air fuel ratio feedback control (step S130 to S230) is executed to perform stoichiometric, homogeneous charge combustion (step S260) or, if necessary, rich, homogeneous charge combustion.

Figure 19:
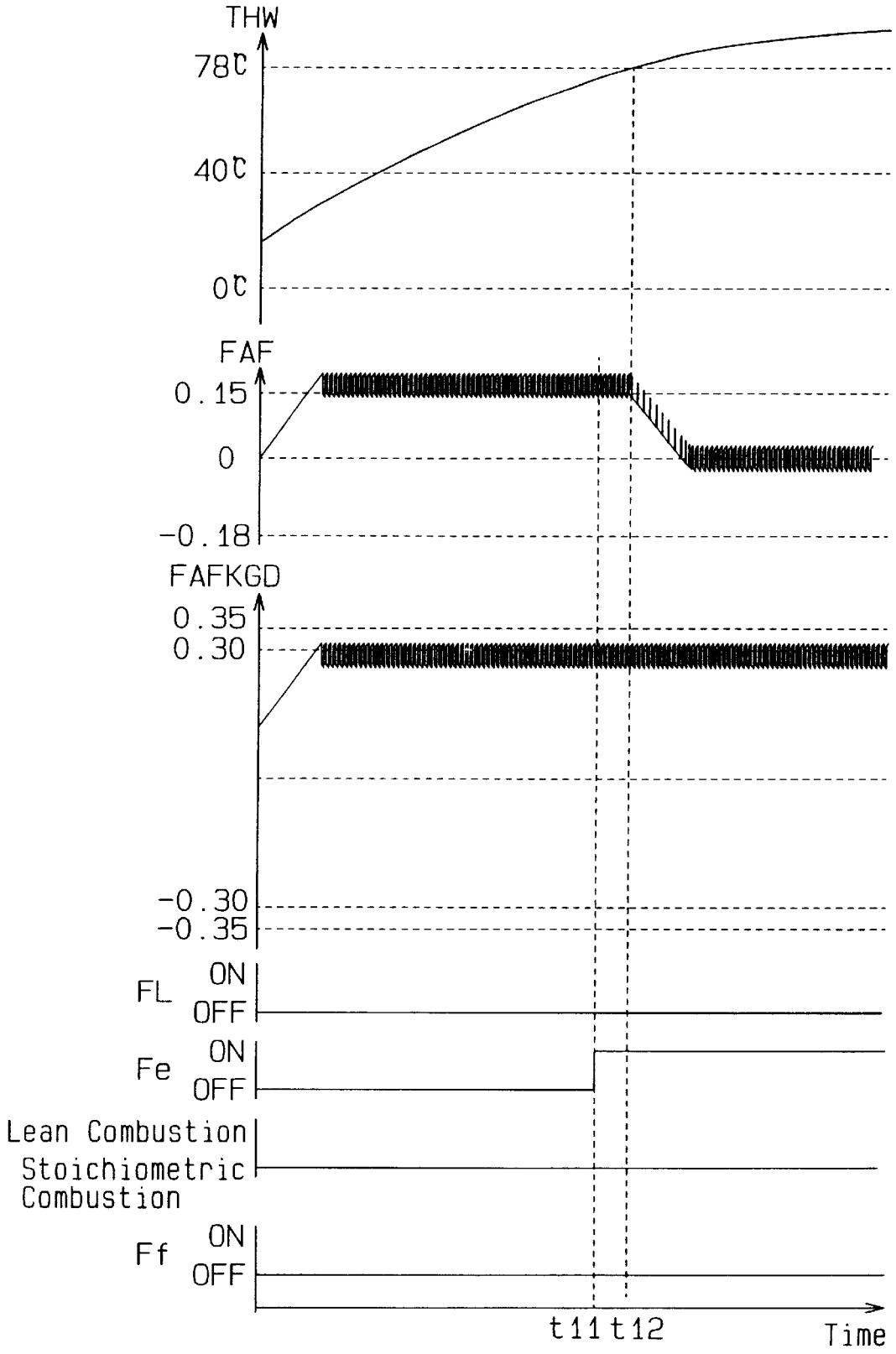
FIG. 19 is a timing chart showing a further control example.

FIG. 19 is a timing chart of an example in which the fuel supply system cannot be clearly determined as functioning normally in the preliminary test.

When the engine 2 is started, the coolant temperature THW is less than 40° C. At time t11, the formulas (3) and (4) of step S342 have not been satisfied continually for ten seconds. However, formula (6) has been satisfied for a cumulative time of over 30 seconds. At this time, the normality of the fuel supply system is determined to be ambiguous by the preliminary test. The permission flag FL remains OFF and the preliminary test completion flag Fe is set to ON (step S370). Thus, the preliminary test is not executed again (step S350) as long as the engine 2 continues to operate.

The engine 2 is warmed at time t12. After time t12, regardless of whether the engine operating state is in operational range R1 or R2, the permission flag FL is determined as not being ON in step S250 of the routine for controlling the fuel injection timing (FIG. 9). Thus, in the following step S260, the fuel injection timing is set so that fuel is injected during the intake stroke. The permission flag FL is also determined as not being ON in step S185 of the routine for controlling the fuel injection amount (FIG. 10). Thus, lean combustion is not permitted. Accordingly, the engine 2 performs stoichiometric combustion (and, if necessary, rich combustion). Thus, air fuel ratio feedback control is executed properly.

In this embodiment, steps S320, S340, and S350 are performed to conduct the preliminary test. Steps S185 and S250 are performed to prohibit lean combustion. Steps S330, S380, and S390 are performed to conduct the main test.

The present embodiment has the advantages described below.

The preliminary test (step S350) immediately determines whether the fuel supply system is functioning normally if the behavior of the feedback compensating coefficient FAF is normal even if the engine 2 is being warmed up.

The main test (step S390) does not determine that the fuel supply system has an abnormality unless the engine 2 is warm and operating stably. This is because when the operation of the engine 2 is unstable, the engine 2 may momentarily enter a state in which the fuel supply system is determined as having an abnormality even if the fuel supply system is functioning normally. Further, when the operating state of the engine 2 is stable, lean, stratified charge combustion is performed. Thus, it was difficult to test the fuel supply system based on the feedback compensating coefficient FAF in the prior art.

Accordingly, if the ECU 60 determines that the fuel supply system may have an abnormality (test result A2) in the preliminary test (step S350), lean combustion is prohibited (steps S250 and S185). Further, air fuel ratio feedback control during stoichiometric combustion is performed even if the operating state of the engine 2 is stable. This facilitates the main test and generates accurate test results.

If the fuel supply system is determined as having an abnormality during the preliminary test (step S350), the permission flag FL goes ON (step S360). This permits lean combustion (steps S250 and S185). Thus, in a state in which lean combustion can be performed, stoichiometric combustion is not performed even if the fuel supply system is functioning normally.

Accordingly, abnormality of the fuel supply system is easily diagnosed, prohibition of lean combustion is minimized, and a decrease in fuel efficiency is prevented.

In the preliminary test (step S350), the ECU 60 tests the fuel supply system in accordance with the feedback compensating coefficient FAF even when the engine 2 is being warmed up. In the main test (step S390), the ECU 60 tests the fuel supply system in accordance with the feedback compensating coefficient FAF after the engine 2 is warmed.

The ECU 60 checks the fuel supply system by performing the preliminary test (step S350) before the main test (step S390). If the ECU 60 determines that the fuel supply system may have an abnormality (test result A2) in the preliminary test, lean combustion is prohibited (steps S250 and S185). When the engine 2 is warm and operating stably, air fuel ratio feedback control for stoichiometric combustion is performed for a sufficient period of time. Thus, the feedback compensating coefficient FAF is calculated when the engine 2 is warm and operating stably. This enables the ECU 60 to easily and accurately test the fuel supply system for abnormalities based on the feedback compensating coefficient FAF during the main test (step S390).

When the engine 2 is being started and the temperature of the engine 2 (coolant temperature THW) is higher then the reference temperature (40° C.), which is lower than the temperature at which the engine 2 is warmed up (78° C.), the ECU 60 determines that the fuel supply system is functioning normally in the preliminary test (step S350). In other words, if the coolant temperature THW is higher than the reference value when starting the engine 2, the engine 2 is warmed up within a short period of time. This makes it difficult to determine whether or not the fuel supply system is functioning normally in the preliminary test. Therefore, if the coolant temperature THW exceeds the reference temperature THW, the ECU 60 presumes that the fuel supply system is functioning normally and does not prohibit lean combustion. This prevents the combustion mode from being forcibly switched to stoichiometric combustion when the engine operating state allows for lean combustion and avoids a decrease in the fuel efficiency.

The ECU 60 determines that the fuel supply system is functioning normally when formulas (3) and (4) are continually satisfied for ten seconds or longer. The normality test result is generated more easily than the abnormality test result generated during the main test even if the engine 2 is in an unstable state such as when it is being warmed up. In other words, if the conditions of formulas (3) and (4) are satisfied for ten seconds, the fuel supply system is definitely normal.

In the preliminary test, if the conditions of formulas (3) and (4) are not satisfied for ten seconds or longer and the condition of formula (6) is satisfied for 30 seconds (measured in step S344), the ECU 60 determines that there is a possibility of the fuel supply system having an abnormality. Accordingly, lean combustion is prohibited in steps S185 and S250.

In the preliminary test (step S350), if the fuel supply system has a history of being determined as having an abnormality during the main test in the present or previous operation of the engine 2, the ECU 60 generates a test result indicating that the fuel supply system may have an abnormality.

The above embodiment may be modified as described below.

In the preliminary test (step S350), the requirement of formula (9) being satisfied may be added to condition (7) of the test result A2 in the preliminary test (step S350).

$$FAF-1.0<-0.18 \quad (9)$$

In step S204, the average value FAFAV of the previous feedback compensating coefficient FAF and the present feedback compensating coefficient FAF may be used to obtain an average weighted previous average value FAFAV.

In addition to an engine that performs lean, stratified charge combustion, the present invention may be applied to an engine that performs lean, homogeneous charge combustion. The present invention may also be applied to an engine that selects one of stratified charge and homogeneous charge when performing lean combustion.

It should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope and equivalence of the appended claims.

What is claimed is:

1. A combustion controller of an engine having a fuel supply system for supplying fuel, wherein the combustion controller selects a combustion mode performed by the engine from either one of lean combustion, in which an air fuel mixture leaner than a stoichiometric mixture is burned, and stoichiometric combustion, in which a stoichiometric mixture is burned, in accordance with an operating state of the engine, and feedback controls the air fuel ratio of the air fuel mixture when the stoichiometric combustion is performed using an air fuel ratio feedback compensating value, which is set in accordance with a component concentration in an exhaust gas, the controller comprising:

a preliminary testing means for testing the fuel supply system and determining that the fuel supply system is in a normal state when one of a plurality of predetermined first conditions is satisfied, wherein the first conditions include a condition using the feedback compensating value;

a lean combustion prohibiting means for prohibiting the lean combustion when the preliminary testing means determines that the state of the fuel supply system is ambiguous; and a main testing means for testing the fuel supply system and determining that the fuel supply system is in an abnormal state when one of a plurality of predetermined second conditions is satisfied, wherein the second conditions include a condition using the feedback compensating value.

2. The combustion controller according to claim 1, wherein the feedback compensating value used by the preliminary testing means is determined when the engine performs the stoichiometric combustion while being warmed up, and the feedback compensating value used by the main testing means is determined when the engine performs stoichiometric combustion after being warmed up.

3. The combustion controller according to claim 2, wherein the first conditions include a temperature condition in which the temperature of the engine when being started exceeds a predetermined temperature that is lower than a temperature corresponding to when the engine has been warmed up.

4. The combustion controller according to claim 1, wherein the first conditions include a normality range condition in which the feedback compensating value is included within a predetermined first normality range when a sum of the feedback compensating value and a learned value of the feedback compensating value is included within a predetermined second normality range for a predetermined normality reference time.

5. The combustion controller according to claim 4, wherein the preliminary testing means determines that the state of the fuel supply system is ambiguous if the normality range is not satisfied when the feedback compensating value is included within a predetermined abnormality range for a predetermined abnormality reference time.

6. The combustion controller according to claim 1, wherein the preliminary testing means determines that the state of the fuel supply system is ambiguous when the main testing means determines during at least the present and previous operation of the engine that the fuel supply system has an abnormality.

7. The combustion controller according to claim 1, wherein a requirement for activating the preliminary testing means is more lenient than that for activating the main testing means.

8. The combustion controller according to claim 7, wherein the preliminary testing means activation requirement includes the operating stability of the engine.

9. The combustion controller according to claim 1, wherein the preliminary testing means does not test the fuel supply system once the preliminary testing means determines that the fuel supply system is in a normal state as long as the engine is continually operating.

10. A method for controlling combustion in an engine, which has a fuel supply system for supplying fuel, by selecting a combustion mode performed by the engine from either one of lean combustion, in which an air fuel mixture leaner than a stoichiometric air fuel mixture is burned, and stoichiometric combustion, in which a stoichiometric air fuel mixture is burned, in accordance with an operating state of the engine, and feedback controlling an air fuel ratio of the air fuel mixture when the stoichiometric combustion is performed, the method comprising:

setting an air fuel ratio feedback compensating value in accordance with a component concentration in an exhaust gas when executing feedback control during stoichiometric combustion;

preliminarily testing the fuel supply system and determining that the fuel supply system is in a normal state when one of a plurality of predetermined first conditions is satisfied, wherein the first conditions include a condition using the feedback compensating value;

prohibiting the lean combustion when the state of the fuel supply system is determined to be ambiguous in the preliminary testing step; and main testing the fuel supply system and determining that the fuel supply system is in an abnormal state when one of a plurality of predetermined second conditions is satisfied, wherein the second conditions include a condition using the feedback compensating value.

11. The method according to claim 10, wherein the feedback compensating value used in the preliminary testing step is determined when the engine performs the stoichiometric combustion while being warmed up, and the variable feedback compensating value used in the main testing step is determined when the engine performs stoichiometric combustion after being warmed up.

12. The method according to claim 11, wherein the first conditions include a temperature condition in which the temperature of the engine when being started exceeds a predetermined temperature that is lower than a temperature corresponding to when the engine has been warmed up.

13. The method according to claim 10, wherein the first conditions include a normality range condition in which the feedback compensating value is included within a predetermined first normality range when a sum of the feedback compensating value and a learned value of the feedback compensating value is included within a predetermined second normality range for a predetermined normality reference time.

14. The method according to claim 13, wherein the state of the fuel supply system is determined to be ambiguous in the preliminary testing step if the normality range is not satisfied when the feedback compensating value is included within a predetermined abnormality range for a predetermined abnormality reference time.

15. The method according to claim 10, wherein the state of the fuel supply system is determined to be ambiguous in the preliminary testing step when the fuel supply system is determined as having an abnormality during at least the present and previous operation of the engine in the main testing step.

16. The method according to claim 10, wherein a requirement for performing the preliminary testing step is more lenient than that for performing the main testing step.

17. The method according to claim 16, wherein the requirement for performing the preliminary testing step includes the operating stability of the engine.

18. The method according to claim 10, wherein the fuel supply system is not tested in the preliminary testing step once the fuel supply system is determined to be in a normal state during the preliminary testing step as long as the engine is continually operating.

19. A method of controlling engine combustion comprising the steps of:

performing a preliminary test while the engine temperature is less than a predetermined temperature, the preliminary test for detecting a normality in a fuel system that provides fuel to the engine;

performing stoichiometric combustion and inhibiting lean combustion if an abnormality in the fuel system is detected by the preliminary test;

after the engine temperature exceeds the predetermined temperature, performing air fuel ratio feedback control for stoichiometric combustion for a predetermined time period;

performing a main test after the engine temperature exceeds the predetermined temperature and the predetermined time period has expired, the main test for detecting abnormalities in the fuel system using a feedback compensating coefficient calculated via the feedback control, wherein the main test prohibits lean combustion while an abnormality is detected.

20. The method according to claim 19, wherein if the engine temperature exceeds the predetermined temperature when the engine is started, the preliminary test is not performed.

* * * * *